US011554936B2

(12) United States Patent
Weibel et al.

(10) Patent No.: US 11,554,936 B2
(45) Date of Patent: Jan. 17, 2023

(54) MOVING A HEAVY OVERLOAD WITH AN ELEVATOR

(71) Applicant: Inventio AG, Hergiswil (CH)

(72) Inventors: Andre Weibel, Ballwil (CH); Enrique Almada, Obernau (CH); Robert Stalder, Rickenbach (CH)

(73) Assignee: INVENTIO AG, Hergiswil (CH)

( * ) Notice: Subject to any disclaimer, the term of this patent is extended or adjusted under 35 U.S.C. 154(b) by 63 days.

(21) Appl. No.: 16/879,833

(22) Filed: May 21, 2020

(65) Prior Publication Data

US 2020/0331727 A1 Oct. 22, 2020

Related U.S. Application Data

(62) Division of application No. 15/571,896, filed as application No. PCT/EP2016/060027 on May 4, 2016, now abandoned.

(30) Foreign Application Priority Data

May 6, 2015 (EP) ..... 15166661

(51) Int. Cl.

| | |
|---|---|
| ***B66B 11/08*** | (2006.01) |
| ***B66B 5/14*** | (2006.01) |
| ***B66B 7/06*** | (2006.01) |
| ***B66B 15/04*** | (2006.01) |
| ***B66B 11/04*** | (2006.01) |

(52) U.S. Cl.

CPC ..... *B66B 11/08* (2013.01); *B66B 5/14* (2013.01); *B66B 7/068* (2013.01); *B66B 11/043* (2013.01); *B66B 15/04* (2013.01); *B66B 5/145* (2013.01)

(58) Field of Classification Search

CPC ..... B66B 5/14; B66B 7/068; B66B 11/08; B66B 11/043; B66B 15/04; B66B 5/145

See application file for complete search history.

(56) References Cited

U.S. PATENT DOCUMENTS

| | | | | |
|---|---|---|---|---|
| 1,944,772 | A * | 1/1934 | White | B66B 7/068 187/265 |
| 2,827,980 | A | 3/1958 | Suozzo et al. | |
| 4,620,615 | A | 11/1986 | Morris et al. | |
| 5,921,352 | A | 7/1999 | Garrido et al. | |
| 5,929,400 | A | 7/1999 | Colby et al. | |
| 5,957,242 | A | 9/1999 | Suter et al. | |
| 5,984,052 | A | 11/1999 | Cloux et al. | |
| 6,742,627 | B2 | 6/2004 | Drabot et al. | |

(Continued)

FOREIGN PATENT DOCUMENTS

| | | |
|---|---|---|
| CN | 1557693 A | 12/2004 |
| CN | 102666347 A | 9/2012 |

(Continued)

*Primary Examiner* — Minh Truong

(74) *Attorney, Agent, or Firm* — William J. Clemens; Shumaker, Loop & Kendrick, LLP

(57) ABSTRACT

An elevator installation and a method of operating the elevator system for temporary transportation of an overload within the elevator installation includes a car and a counterweight interconnected by one or more suspension ropes engaging a traction sheave that is driven by a motor. The traction between the suspension ropes and the traction sheave is enhanced independently of the counterweight for intended overload operation.

16 Claims, 6 Drawing Sheets

(56) References Cited

U.S. PATENT DOCUMENTS

| | | | | |
|---|---|---|---|---|
| 7,207,550 | B2 | 4/2007 | Spiess et al. | |
| 8,109,369 | B2 | 2/2012 | Fischer | |
| 8,556,041 | B2 | 10/2013 | Mustalahti et al. | |
| 9,783,390 | B2 | 10/2017 | Valjus | |
| 2009/0120733 | A1 | 5/2009 | Mustalahti et al. | |
| 2009/0229922 | A1* | 9/2009 | Smith | B66B 1/42 187/264 |
| 2010/0236870 | A1 | 9/2010 | Kostka | |
| 2012/0112577 | A1 | 5/2012 | Strbuncelj et al. | |
| 2012/0201638 | A1 | 8/2012 | Perala et al. | |

FOREIGN PATENT DOCUMENTS

| | | | |
|---|---|---|---|
| CN | 107567425 | A | 1/2018 |
| EP | 0763495 | A1 | 3/1997 |
| JP | H06135653 | A | 5/1994 |
| JP | H0920480 | A | 1/1997 |
| JP | 2000118903 | A | 4/2000 |
| JP | 2004203601 | A | 7/2004 |
| KR | 100829319 | B1 | 5/2006 |
| WO | 2011039405 | A1 | 4/2011 |

* cited by examiner

MOVING A HEAVY OVERLOAD WITH AN ELEVATOR

CROSS-REFERENCE TO RELATED APPLICATIONS

This application is a divisional of the U.S. patent application Ser. No. 15/571,896 filed Nov. 6, 2017.

FIELD

The present invention relates to an elevator and a method of temporarily operating the elevator outside of normal, nominal operating conditions so as to enable the transportation of a heavy overload from one floor to another.

BACKGROUND

In order to maximize installation efficiency while maintaining cost-effectiveness, elevators are conventionally designed and commissioned to operate within predetermined nominal operating conditions, such as rated load and speed, to satisfy the specified transport requirements for a specific installation.

There are, however, temporary and infrequent occasions when it would be useful for the building owner to be able to operate the elevator outside of the nominal operating conditions e.g. for transporting a heavy article, such as an electrical transformer, that would otherwise overload the elevator.

Conventionally, a solution has been used whereby the mass of the counterweight is increased in proportion to the intended overload of the car so as to maintain the balancing factor between the car and counterweight. After the overload has been transported to the desired location, the additional mass is removed from the counterweight and the elevator can be returned to normal operation.

An alternative solution has been described in WO-A1-2011/039405 wherein an additional hoist is attached to the elevator car to supplement the existing elevator drive and thereby compensate for the overload. As with the previous example, after the overload has been transported to the desired location, the additional hoist can be detached from the car and the elevator can be returned to normal operation.

In both the methods described above the technician is required to attach additional equipment to an elevator component which is designed to move substantial distances within the hoistway, such as affixing a substantial additional mass to the counterweight or attaching an additional hoist to the elevator car. Not only are these procedures time-consuming and cumbersome but they can also be inherently dangerous. Furthermore, in the first procedure described above, the additional mass is generally added to the counterweight from the pit of the elevator installation. The resultant severely overbalanced elevator is then moved by the drive so that the overload, e.g. transformer, can be loaded into the empty car from the ground floor. This severely unbalanced trip requires the drive to produce and the motor to consume substantially larger electrical currents than during normal operation which can greatly reduce the lifespan of both electrical components.

SUMMARY

An objective of the present invention is to enable the temporary transportation of an overload within an elevator installation having a car and a counterweight interconnected by one or more suspension ropes engaging a traction sheave which is driven by a motor. Instead of adding an additional hoist to the car or additional mass to the counterweight, the traction between the suspension ropes and the traction sheave is enhanced independently of the counterweight. Instead of adding additional mass to the counterweight as in the prior art previously discussed, the enhanced traction between the suspension ropes and the traction sheave according to the present invention facilitates the temporary operation the elevator outside of normal, nominal operating conditions so as to enable the transportation of a heavy overload from one floor to another.

Preferably, enhanced traction is achieved by increasing the tension on a compensation rope suspended between the car and counterweight. An actuator can be provided for selectively applying force to the compensation rope.

Alternatively, the traction can be enhanced by squeezing the ropes in grooves on the traction sheave. In such a case, the traction sheave may be provided with an undercut to improve traction between the suspension ropes and the traction sheave or V-grooves can be provided on the traction sheave. In another example a liner is introduced between the traction sheave and the suspension ropes to enhance traction.

In an alternative arrangement, a device may be installed to exert pressure on the suspension ropes as they engage with the traction sheave over a wrap angle. The pressure exertion device may comprise a tensioned, closed-loop belt entrained over one or more rollers.

Traction may be enhanced by increasing the wrap angle over which the suspension ropes engage the traction sheave. If the suspension ropes between the car and the counterweight follow a path over the traction sheave and a deflection pulley, the deflection pulley can be displaced to change the wrap angle. Alternatively, an additional pulley can be introduced between the sheave and the deflection pulley to change the wrap angle.

Preferably, the motor is switchable between parallel and series configuration.

During intended overload operation, the speed and acceleration of the elevator can be reduced, forced cooling can be introduced through the drive and the motor, the travel path to transport the overload can be broken up with intermediate stops and/or the number of starts the elevator can make in an hour can be restricted.

DESCRIPTION OF THE DRAWINGS

Other objectives, features and advantages of the present invention will be apparent from the following detailed description of preferred embodiments thereof taken in conjunction with the accompanying drawings, in which.

DETAILED DESCRIPTION

Figure 1:
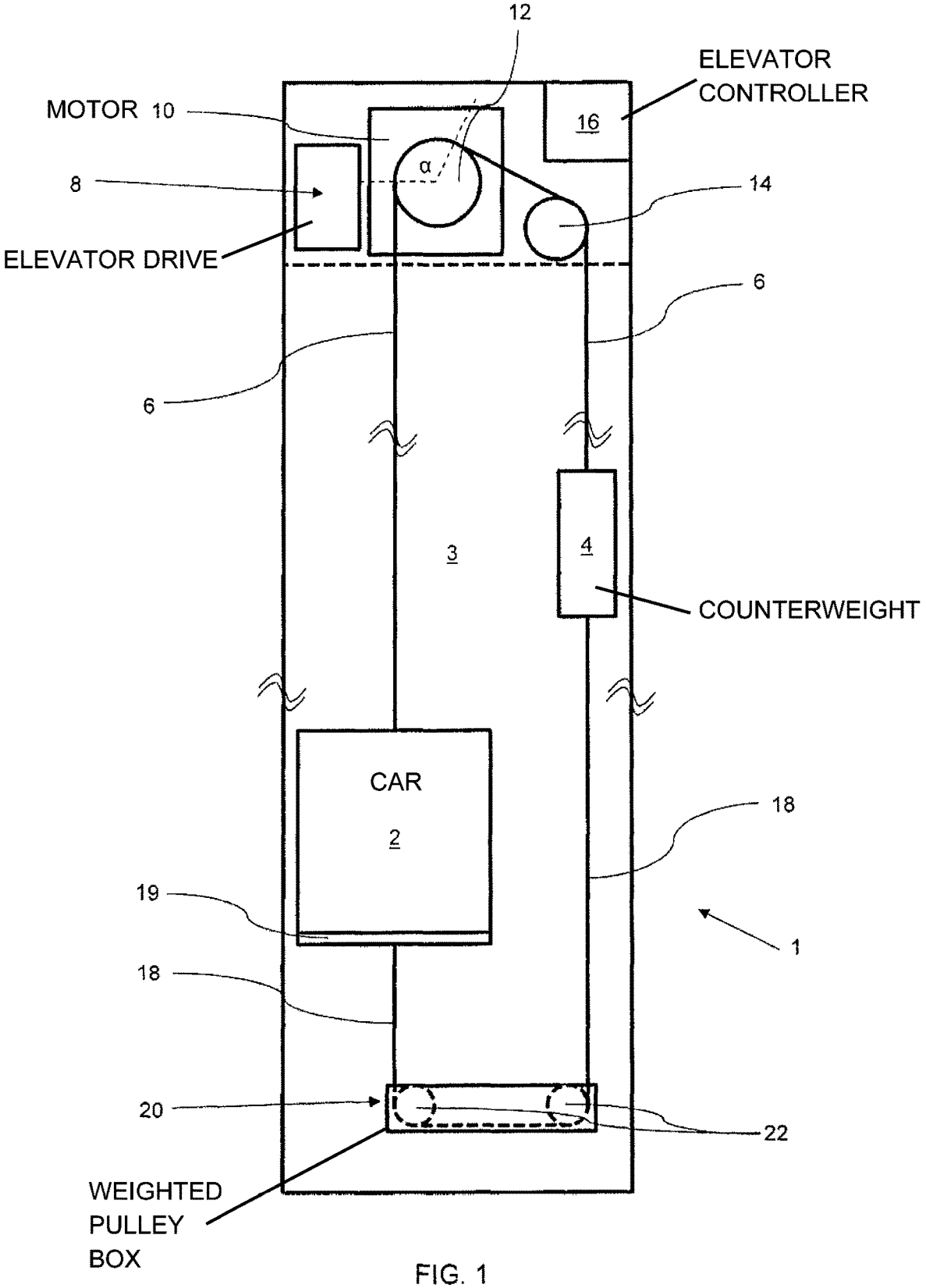
FIG. 1 is an exemplary schematic showing an arrangement of components within an elevator installation according to the present invention.

FIG. 1 illustrates an exemplary embodiment of an arrangement of components within a typical high-rise elevator installation 1. An elevator drive 8, a deflection pulley 14 and an elevator controller 16 are arranged in a machine room above a hoistway 3. Within the hoistway 3, an elevator car 2 and a counterweight 4 are supported on suspension ropes 6. In this example, the suspension ropes 6 have a 1:1 roping ratio whereby they extend from an end connection fixed to the car 2 up the hoistway 3 for engagement through a wrap angle $\alpha$ with a traction sheave 12 which is rotated by a motor 10 of the elevator drive 8, subsequently over the deflection pulley 14 and back down the hoistway 3 to a further end connection fixed to the counterweight 4. Naturally, the skilled person will easily appreciate other roping arrangements, such as 2:1, 4:1 or x:1 roping ratios, are equally possible and the invention can also be implemented with elevators using belts instead of conventional suspension ropes.

Preferably, the counterweight 4 is designed so that its total mass is equal to the sum of the mass of the empty elevator car 2 plus 50% of the nominal rated load.

In high-rise applications particularly, not only must the imbalance between the car 2 and counterweight 4 be considered, but also the imbalance caused by the weight of the suspension ropes 6 is appreciable. For example, if the car 2 is at the lowest landing within the hoistway 3 and thereby the counterweight 4 is at the highest level within the hoistway 3, the majority of the length of the suspension ropes 6 is located on the car side of the traction sheave 12 rather than on the counterweight side of the sheave 12. To offset this imbalance due to the suspension ropes 6 it is conventional practice to install one or more compensation chains or ropes 18 suspended between the car 2 and the counterweight 4. For convenience only one compensation rope 18 is illustrated in the drawing, but it will be appreciated that more than one compensation rope can be installed. The compensation rope 18 is guided under pulleys 22 in a weighted pulley box 20 located in a pit of the hoistway 3.

Accordingly, the suspension ropes 6, the car 2, the counterweight 4 and the compensation rope 18 form a closed-loop system where the length of the suspension ropes 6 and compensation rope 18 on the car side of the traction sheave 12 is substantially equal to that on the counterweight side of the traction sheave 12.

In normal operation, the elevator controller 16 receives signals from conventional landing operating panels and car operating panels (not shown) to determine the travel path that the elevator 1 must undertake in order to satisfy passengers' travel requests. Once the travel path has been determined, the controller 16 outputs signals to the drive 8 so that the traction sheave 12 can be rotated by the motor 10 in the appropriate direction. The traction sheave 12 engages with the suspension ropes 6 to vertically move the car 2 and counterweight 4 in opposing directions along guiderails (not shown) within the hoistway 3. Additionally, from signals generated by a load measurement device 19 mounted to the elevator car 2, the controller 16 can monitor load within the car 2, and particularly, can determine whether the car 2 is overloaded while stationary at any landing. In this case an overload alarm can be issued within the car 2 to allow some passengers to disembark from the car 2.

If the overload alarm is overridden in the elevator controller 16, and a heavy overload, such as a transformer, is subsequently introduced into the elevator car 2 from a landing, the substantial imbalance between the overloaded car 2 and counterweight 4 will ultimately cause the suspension ropes 6 to slip in the traction sheave 12 resulting in unintended if not uncontrollable car movement. In such an overload condition, the elevator 1 can be severely underbalanced since the mass of the counterweight 4 with the 50% balancing factor as discussed previously is no longer capable of balancing the overloaded elevator car 2.

Figures 2A, 2B:
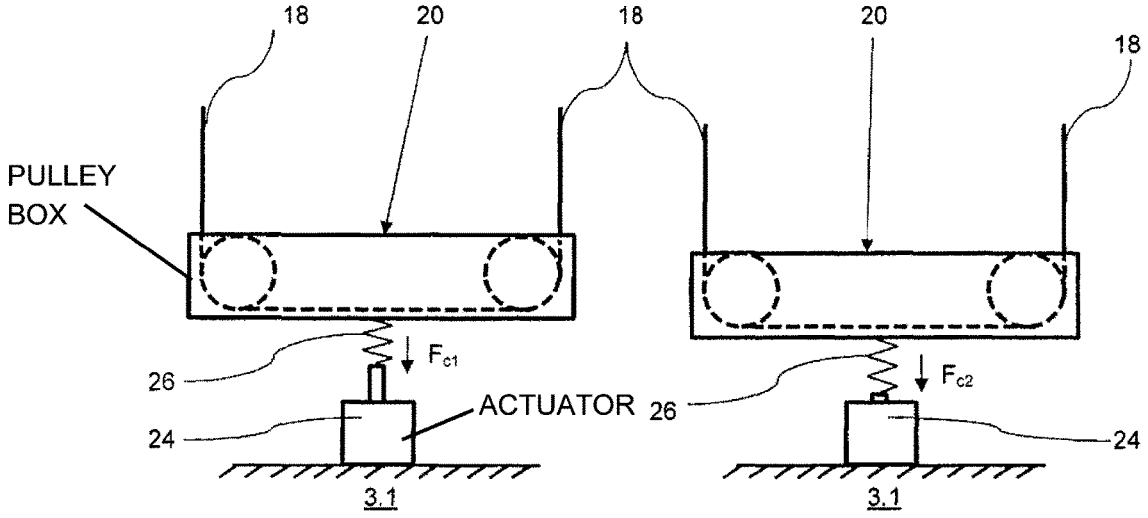
FIG. 2A is a view of the compensation rope tensioning device according to an embodiment of the present invention for use in the installation of FIG. 1.
FIG. 2B corresponds to FIG. 2A but shows the compensation rope tensioning device displaced to a different vertical position to increase the force imparted by the tensioning device on the compensation rope.

A solution to this problem is provided for with a compensation rope tensioning device according to the invention as illustrated in FIGS. 2A and 2B. In this embodiment, the compensation rope pulley box 20 is attached through a damper or spring 26 to an actuator 24 mounted to the pit floor 3.1 of the hoistway 3. In normal operation when the elevator 1 is operating under nominal, rated load conditions, as shown in FIG. 2A, the actuator 24 and spring 26 impose a downward force $F_{c1}$ on the pulley box 20. This force $F_{c1}$ is ultimately transmitted through the compensation rope 18, the car 2 and counterweight 4, to act as tension within the suspension ropes 6.

If however, the elevator installation 1 is to be used for the temporary transportation of an overload within the car 2, the actuator 24 draws the spring 26 and the pulley box 20 downwards imparting a greater downward force $F_{c2}$ on the pulley box 20 resulting in greater tension the suspension ropes 6. This greater tension in the suspension ropes 6 about the traction sheave 12 improves or enhances the traction therebetween reducing the likelihood of slippage when an overload is introduced into the car 2.

The actuator 24 may be hydraulic, pneumatic, electromechanical or purely mechanical and can be automatically operated via command signals from the elevator controller 16 or it can be manually operated from the pit 3.1 of the hoistway.

Although, in the illustrated embodiment, the actuator 24 is used for both normal and overload conditions, it will be appreciated that the weight of the pulley box 20 may be used exclusively to impose the required tension to the compensation rope 18 during normal operation, as in FIG. 1, and the actuator 24 may be temporarily installed to the pit floor 3.1 to increase the downward force $F_{c1}$ on the pulley box 20 for intended overload operation only.

Naturally, the person skilled in the art will also appreciate that instead of the actuator 24, additional weights can be added to the pulley box 20 to increase the downward force $F_{c1}$ acting on the compensation rope pulley box 20 for intended overload operation. Alternatively, additional compensation chains or ropes 18 can be installed to increase the tension in the suspension ropes 6 about the traction sheave 12 resulting in enhanced traction therebetween.

Figures 3A, 3B, 3C:
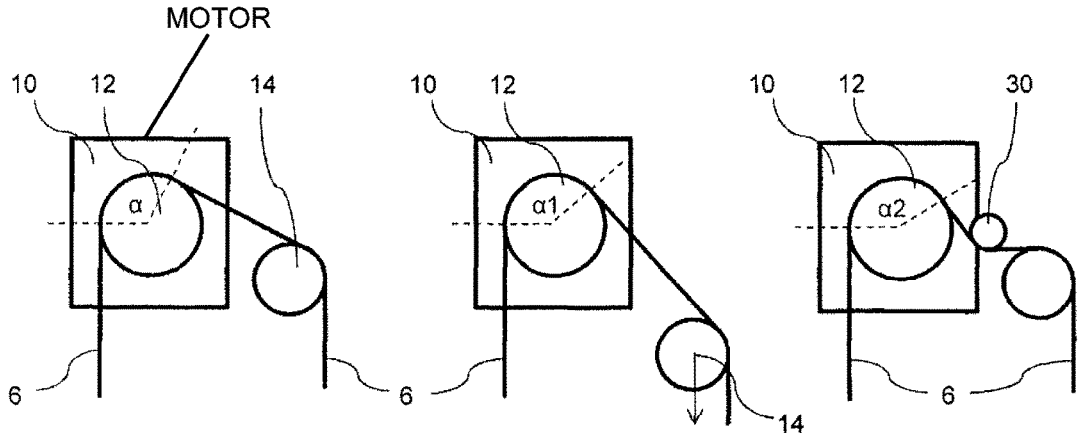
FIG. 3A is a partial view of the traction sheave and deflection pulley of FIG. 1.
FIG. 3B corresponds to FIG. 3A but illustrates a displaceable deflection pulley in accordance with an embodiment of the present invention.
FIG. 3C corresponds to FIG. 3A but illustrates the use of an additional pulley in accordance with an embodiment of the present invention.

FIG. 3A is a plan view of the drive 8 and deflection pulley 14 arrangement from FIG. 1. As previously described, in normal operation, the suspension ropes 6 extend from the car 2 for engagement through a wrap angle $\alpha$ over the traction sheave 12 which is rotated by a motor 10, subsequently over the deflection pulley 14 and back down the hoistway 3 to the counterweight 4.

For overload operation, the arrangement can be modified as illustrated in FIG. 3B or 3C to enhance traction between the traction sheave 12 and the suspension ropes 6. In the example of FIG. 3B, the deflection pulley 14 is vertically displaceable, so that for intended overload operation the pulley 14 is displaced downwards as shown which results in the suspension ropes 6 having a greater wrap angle $\alpha_1$ about the traction sheave 12. Naturally, the deflection pulley 14 could be horizontally displaceable to achieve the required change in the wrap angle $\alpha$.

In the alternative shown in FIG. 3C, the deflection pulley 14 remains in the same position as in FIG. 3A but an additional pulley 30 is introduced between the sheave 12 and the deflection pulley 14 to engage with the suspension ropes 6 and thereby again increase the wrap angle $\alpha_2$.

Figure 4:
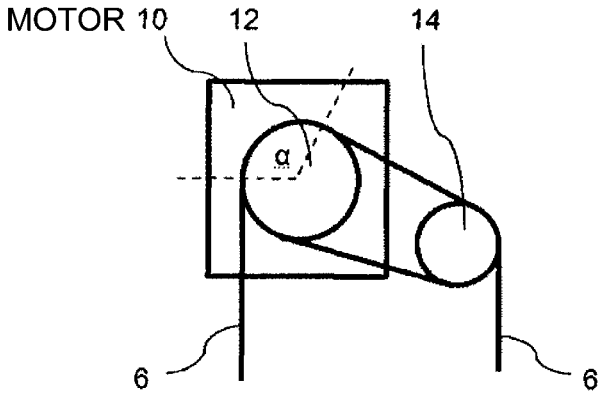
FIG. 4 corresponds to FIG. 3A but illustrates the suspension ropes arrangement in a double wrap over the traction sheave and deflection pulley.

It will be apparent to the skilled person that other arrangements are possible in order to increase the wrap angle to enhance the traction between the suspension ropes 6 and the traction sheave 12. For example, instead of having a single wrap arrangement as shown in FIGS. 3A-3C, the suspension ropes 6 may be double wrapped, as shown in FIG. 4, or even triple wrapped around the traction sheave 12 and the deflection pulley 14.

Figure 5:
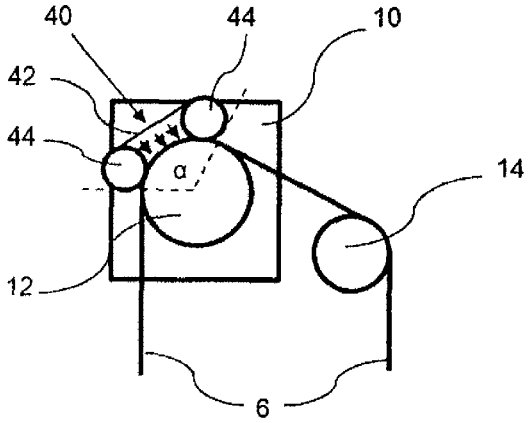
FIG. 5 is a partial view of the traction sheave and deflection pulley of FIG. 1 incorporating a pressure exertion device in accordance with an embodiment of the present invention.

FIG. 5 is a partial view of the machine 10 and deflection pulley 14 of FIG. 1. If an overload operation is intended, a pressure exertion device 40 is provided to exert a pressure (shown by the arrows) on the suspension ropes 6 as they engage the traction sheave over the wrap angle $\alpha$. The device 40 comprises a tensioned, closed-loop belt 42 entrained over two rollers 44. Accordingly, the traction between the ropes 6 and the sheave 12 is enhanced by the additional pressure exerted on the ropes 6 by the closed-loop belt 42 of the device 40.

Figure 6:
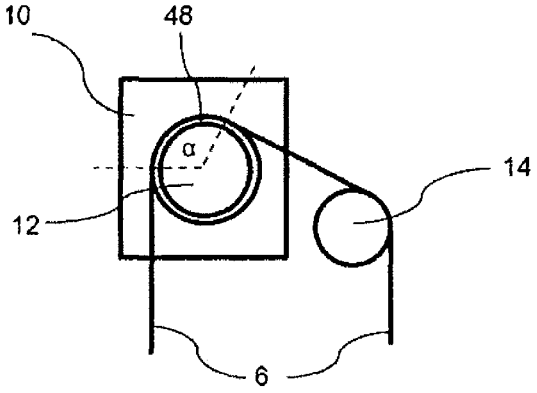
FIG. 6 is a partial view of the traction sheave and deflection pulley of FIG. 1 incorporating a traction sheave liner in accordance with an embodiment of the present invention.

In most conventional high-rise elevator installations 1, as depicted in FIG. 1, the suspension ropes 6 are manufactured from steel and engage with a steel surface on the traction sheave 12. The coefficient of friction of steel-to-steel is relatively low. In such a situation, in order to accommodate overload operation, the arrangement illustrated in FIG. 6 can be implemented wherein a traction sheave liner 48 is introduced between the traction sheave 12 and the suspension ropes 6. The liner 48 is preferably made of a plastics material which enhances the coefficient of friction and thereby the traction of the system.

Figure 7A:
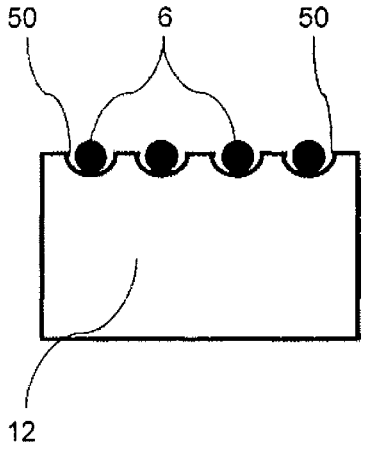
FIG. 7A is an axial cross-section through the top of the traction sheave shown in FIG. 1.
Figure 7B:
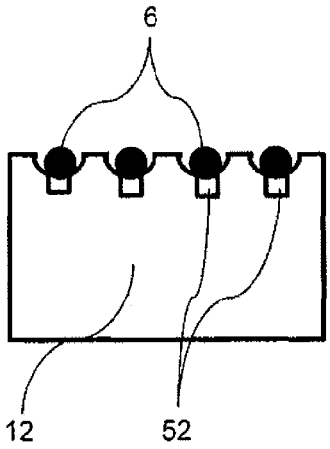
FIG. 7B is an axial cross-section of a traction sheave having an alternative groove arrangement.
Figure 7C:
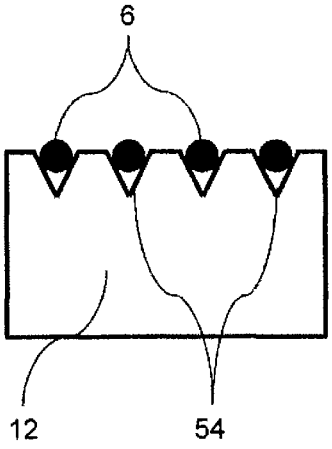
FIG. 7C is an axial cross-section of a traction sheave having a further alternative groove arrangement.

FIG. 7A is an axial cross-section through the top of the traction sheave 12 shown in FIG. 1. The suspension ropes 6 are accommodated in and engage with half-rounded grooves 50 provided around the circumference of the traction sheave 12. In order to enhance the contact and thereby the traction between the suspension ropes 6 and the traction sheave 12 it is possible to provide undercuts 52 as shown in FIG. 7B. Alternatively, V-shaped grooves 54 as shown in FIG. 7C can be implemented to improve contact between the suspension ropes 6 and the traction sheave 12. The person skilled in the art will readily recognize that other groove arrangements on the traction sheave 12 which squeeze the ropes 6 as they engage the traction sheave 12 can be employed to improve contact and thereby traction between the sheave 12 and the ropes 6.

Figure 8A:
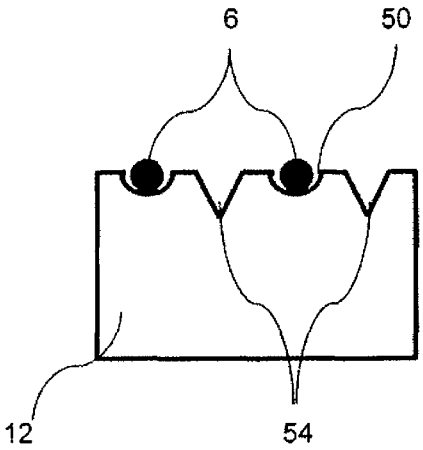
FIG. 8A is an axial cross-section of a traction sheave having a further alternative groove configuration depicting the suspension ropes arranged for normal operation.
Figure 8B:
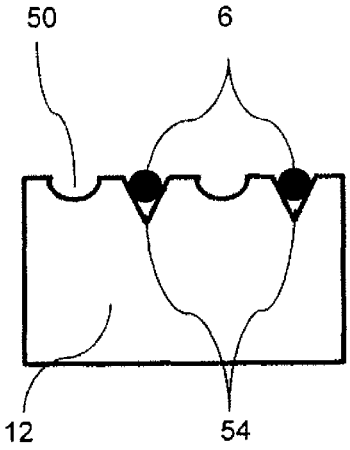
FIG. 8B corresponds to FIG. 8A depicting the suspension ropes arranged for overload operation.

FIGS. 8A and 8B illustrate a traction sheave 12 having an alternate sequence of half-rounded grooves 50 and V-shaped grooves 54 in the axial direction. In FIG. 8A the ropes 6 are accommodated in the half-rounded grooves 50 for normal operation. If overload operation is intended, the ropes 6 can be transferred into the neighboring V-shaped grooves 54 as shown in FIG. 8B to enhance contact and traction between the suspension ropes 6 and the traction sheave 12.

Although each of the previous embodiments of the invention have been described separately, it will be appreciated that features of the individual embodiments can be combined to enhance traction between the traction sheave 12 and the suspension ropes 6.

Figure 9:
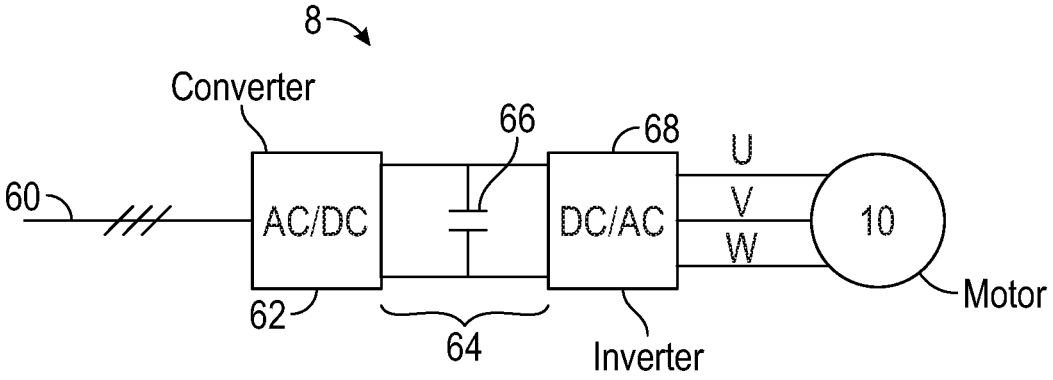
FIG. 9 depicts typical drive arrangement for the elevator installation of FIG. 1.

In addition to any of the techniques described above to enhance traction between the traction sheave 12 and the suspension ropes 6, it is also beneficial to increase the torque transmitted from the motor 10 to the traction sheave 12 when operating the elevator 1 in overload conditions. A typical drive 8 for the elevator installation 1 is depicted in FIG. 9. Electrical power is drawn from a three phase AC mains power supply 60, passed through an AC-DC power converter 62 which supplies DC in a DC bus or link 64, inverted by a DC-AC power inverter 68 and fed in three phases U, V and W onto the three phase AC motor 10. The bus or link 64 includes a capacitor 66 for stabilizing the DC power.

Figure 10A:
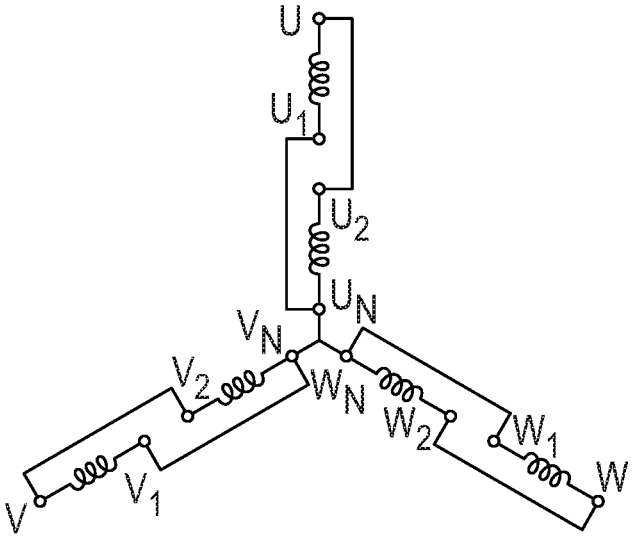
FIGS. 10A and 10B show alternative winding configuration for the motor of FIG. 9.
Figure 10B:
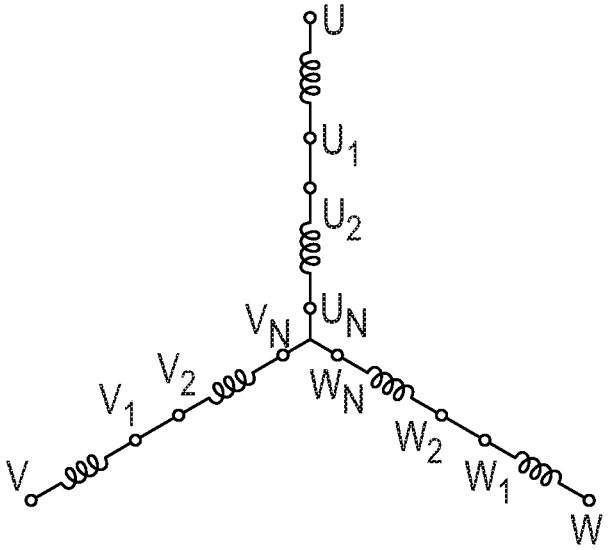

Within the three phase AC motor 10, the armature windings are arranged in double star configuration with the winding pairs of each phase U, V, W arranged in parallel, as shown in FIG. 10A. The windings each are connected between one of the pairs of nodes: $U$-$U_1$; $U_2$-$U_N$; $V$-$V_1$; $V_2$-$V_N$; $W$-$W_1$; and $W_2$-$W_N$. In order to increase the motor torque for operation in overload conditions, the drive 8 should deliver more current, which could exceed the maximum allowable value or overheat the drive's semiconductors. A commutation from parallel to series connection of the motor windings as shown in FIG. 10B decreases the needed current for the required torque. This commutation from parallel to series connection can be conducted manually by a certified technician by appropriate re-wiring of the terminal box of the motor. More preferably, however, the commutation can be achieved by means of an electrical switch attached to the terminal box. The electrical switch can be actuated manually by a technician or can be activated automatically by the elevator controller 16.

By reconfiguring the armature windings as discussed above for intended overload operation, the operating voltage will inherently rise. In order to mitigate against the deleterious effects of over-voltage on the drive 8, the speed and/or the acceleration of the elevator 1 can be reduced, enhanced forced cooling can be implemented through the drive 8 and the motor 10 and the travel path to transport the overload can be broken up with intermediate stops. Preferably, during intended overload operation, the number of starts that the elevator 1 can make in an hour is restricted.

Figure 11:
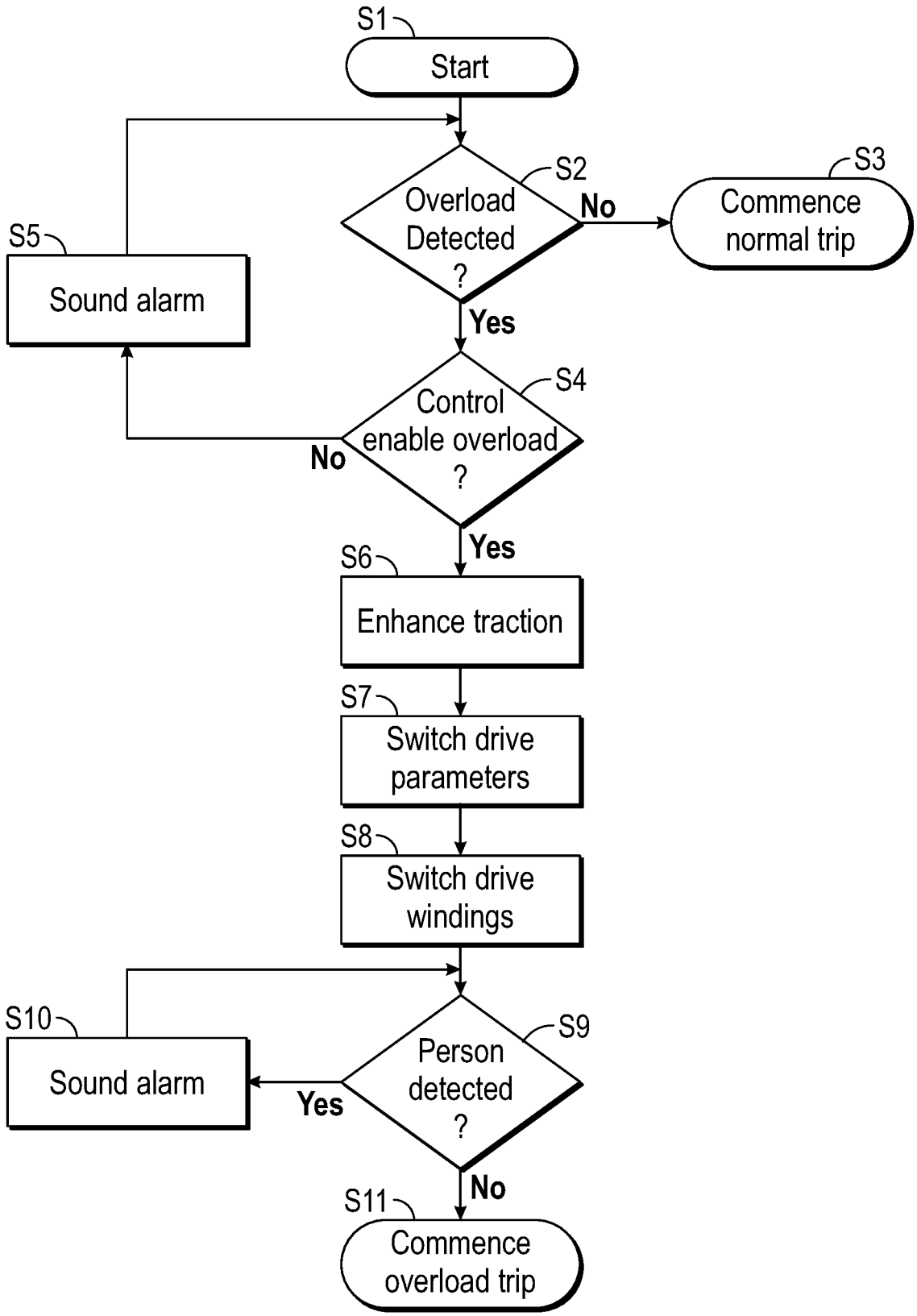
FIG. 11 is a flowchart to illustrate an example of a procedure to temporarily operate the elevator of FIG. 1 outside of normal, nominal operating conditions so as to enable the transportation of a heavy overload from one floor to another.

An example of a procedure to temporarily operate the elevator 1 outside of normal, nominal operating conditions so as to enable the transportation of a heavy overload from one floor to another is explained with reference to the flowchart illustrated in FIG. 11. The process commences at step S1 when the elevator car 2 in response to a call arrives at a landing of the building and the doors are subsequently opened. At this point, the elevator controller 16 can monitor the load within the car from signals generated by the load measurement device 19. If no overload is detected by the controller 16 at step S2, the doors can close and the elevator 1 can commence a normal trip at step S3 in response to conventional elevator calls.

On the contrary, if an overload is detected at step S2, the procedure progresses to step S4 where a determination is made as to whether the controller 16 has been switched or enabled for an overload trip. If at step S4 the controller 16 has not been enabled for an overload trip, then the car 2 remains stationary at the landing with its doors open and an overload alarm can be issued at step S5 within the car 2 to allow some passengers to disembark from the car 2.

If an overload trip has been enabled within the controller 16 at step S4, then traction between the ropes 6 and the traction sheave 12 is enhanced at step S6 in accordance with the examples illustrated in and described previously with respect to FIGS. 2A-8.

Furthermore, at step S7 internal parameters of the drive 8 can be switched by software or keyswitch so as to protect the drive 8 and the motor 10 during the intended overload travel. For example the speed and/or the acceleration of the elevator 1 can be reduced, enhanced forced cooling can be implemented through the drive 8 and the motor 10 and the travel path to transport the overload can be broken up with intermediate stops. Preferably, during intended overload operation, the number of starts that the elevator 1 can make in an hour is restricted.

In step S8, the armature windings can be commutated from parallel to series connection as shown in FIG. 10.

For safety reasons, it is preferable that no person travels in the elevator car 2 with the overload during the overload trip. In step S9, the controller 16 can receive signals from a conventional person detector such as an infrared sensor to determine whether any personal are present in the car 2. If anyone is detected in the car 2, then the car 2 remains stationary at the landing with its doors open and an alarm can be issued at step S10 within the car 2 to allow the detected personnel to disembark from the car 2. When nobody has been detected in the car 2 at step S9, the doors can close and the elevator 1 can commence an overload trip at step S11.

The procedural steps outlined above can be carried out automatically by the elevator controller 16, manually by a trained technician or there can be a combination with some of the steps manually implemented and others automatically implemented.

Having illustrated and described the principles of the disclosed technologies, it will be apparent to those skilled in the art that the disclosed embodiments can be modified in arrangement and detail without departing from such principles. In view of the many possible embodiments to which the principles of the disclosed technologies can be applied, it should be recognized that the illustrated embodiments are only examples of the technologies and should not be taken as limiting the scope of the invention.

In accordance with the provisions of the patent statutes, the present invention has been described in what is considered to represent its preferred embodiment. However, it should be noted that the invention can be practiced otherwise than as specifically illustrated and described without departing from its spirit or scope.

What is claimed is:

1. A method for temporary transportation of an overload within an elevator installation, the elevator installation having a car and a counterweight interconnected by at least one suspension rope engaging a traction sheave driven by a motor, the method comprising the step of:

enhancing traction between the at least one suspension rope and the traction sheave independently of a weight of the counterweight by providing a compensation rope tensioning device having a compensation rope pulley box attached to an actuator through a damper or a spring, the actuator being mounted to a pit floor of a hoistway in which the car and the counterweight are positioned, the compensation rope pulley box engaging at least one compensation rope suspended between the car and the counterweight;

wherein during a normal operation of the elevator installation the actuator and the damper or the spring impose a downward force on the compensation rope pulley box, the downward force being transmitted through the at least one compensation rope, the car and the counterweight to act as tension within the at least suspension rope;

when an overload is detected, determining whether an elevator controller controlling the motor is enabled for an overload trip;

when the elevator controller is not enabled for an overload trip, maintaining the car stationary at a landing; and when the elevator controller is enabled for an overload trip, the elevator installation is used for a temporary transportation of the detected overload, the actuator draws the damper or the spring and the compensation rope pulley box downwards imparting an increased downward force on the compensation rope pulley box resulting in an increased tension within the at least one suspension rope.

2. The method according to claim 1 wherein the enhancing traction is performed by exerting pressure on the at least one suspension ropes as it passes over the traction sheave.

3. The method according claim 1 further comprising a step of switching armature windings of the motor from a parallel configuration to a series configuration.

4. The method according to claim 1 further comprising a step of reducing at least one of a speed and an acceleration of the elevator installation for transportation of the overload.

5. The method according to claim 1 further comprising a step of transporting the overload with at least one of intermediate stops and restricting a number of starts the elevator installation can make in an hour.

6. The method according to claim 1 further comprising a step of introducing forced cooling through the motor and a drive associated with the motor.

7. The method according to claim 1 wherein the compensation rope pulley box is positioned above the actuator.

8. An elevator installation comprising:

a car;

a counterweight interconnected with the car by at least one suspension rope engaging a traction sheave driven by a motor;

an elevator controller controlling the motor and being switchable between being enabled for an overload trip and not being enabled for an overload trip;

a compensation rope tensioning device for enhancing traction between the at least one suspension rope and the traction sheave independently of a weight of the counterweight for temporary transportation of an overload, the compensation rope tensioning device having a compensation rope pulley box attached to an actuator through a damper or a spring, the actuator being mounted to a pit floor of a hoistway in which the car and the counterweight are positioned, the compensation rope pulley box engaging at least one compensation rope suspended between the car and the counterweight;

wherein during a normal operation of the elevator installation the actuator and the damper or the spring impose a downward force on the compensation rope pulley box, the downward force being transmitted through the at least one compensation rope, the car and the counterweight to act as tension within the at least suspension rope; and when the elevator controller is not enabled for an overload trip, the elevator controller maintains the car stationary at a landing upon detection of an overload in the car and when the elevator controller is enabled for an overload trip, the elevator installation is used for a temporary transportation of a detected overload in the car, and the actuator draws the damper or the spring and the compensation rope pulley box downwards imparting an increased downward force on the compensation rope pulley box resulting in an increased tension within the at least one suspension rope.

9. The elevator installation according to claim 8 wherein the device includes a pressure exertion device for exerting a pressure on the at least one suspension rope as the at least one suspension rope engages the traction sheave over a wrap angle.

10. The elevator installation according to claim 9 wherein the pressure exertion device includes a tensioned, closed-loop belt entrained over at least one roller.

11. The elevator installation according to claim 8 wherein the motor has motor windings that are switchable from a parallel configuration to a series configuration.

12. The elevator installation according to claim 8 wherein the counterweight has a total mass equal to or greater than a sum of a mass of car when empty plus 50% of a nominal rated load so that during the temporary transportation of the overload the elevator installation is underbalanced.

13. The elevator installation according to claim 8 wherein the compensation rope pulley box is positioned above the actuator.

14. A method for temporary transportation of an overload within an elevator installation, the elevator installation having a car and a counterweight interconnected by at least one suspension rope engaging a traction sheave driven by a motor, the method comprising the steps of:

enhancing traction between the at least one suspension rope and the traction sheave independently of a weight of the counterweight by providing a compensation rope tensioning device having a compensation rope pulley box attached to an actuator through a damper or a spring, the actuator being mounted to a pit floor of a hoistway in which the car and the counterweight are positioned, the compensation rope pulley box engaging at least one compensation rope suspended between the car and the counterweight;

monitoring a load within the car when the car is stopped at a landing of the hoistway to detect an overload;

when the overload is not detected, commencing a normal operation of the elevator installation wherein the actuator and the damper or the spring impose a downward force on the compensation rope pulley box, the downward force being transmitted through the at least one compensation rope, the car and the counterweight to act as tension within the at least suspension rope;

when the overload is detected and the elevator installation is not enabled for an overload trip, sounding an overload alarm and preventing the car from moving; and when the overload is detected, determining whether an elevator controller controlling the motor is enabled for an overload trip and when the elevator controller is enabled for an overload trip, further enhancing traction by operating the actuator to draw the damper or the spring and the compensation rope pulley box downwards imparting an increased downward force on the compensation rope pulley box resulting in an increased tension within the at least one suspension rope.

15. The method according to claim 14 further comprising a step of when the overload is detected and the elevator installation is enabled for the overload trip, monitoring for any personnel in the car and sounding an alarm within the car and preventing the car from moving.

16. The method according to claim 14 wherein the compensation rope pulley box is positioned above the actuator.

* * * * *